US009944423B2

(12) United States Patent
Zacche'

(10) Patent No.: US 9,944,423 B2
(45) Date of Patent: Apr. 17, 2018

(54) LABELLING UNIT OF CONTAINERS

(71) Applicant: SMILAB S.r.l., Bergamo (IT)

(72) Inventor: Vanni Zacche', Bergamo (IT)

(73) Assignee: SMILAB S.r.l., Bergamo (IT)

( * ) Notice: Subject to any disclaimer, the term of this patent is extended or adjusted under 35 U.S.C. 154(b) by 600 days.

(21) Appl. No.: 14/327,227

(22) Filed: Jul. 9, 2014

(65) Prior Publication Data

US 2015/0013914 A1 Jan. 15, 2015

(30) Foreign Application Priority Data

Jul. 10, 2013 (IT) ..... MI2013A1161

(51) Int. Cl.

| | |
|---|---|
| ***B65C 9/18*** | (2006.01) |
| ***B65C 9/40*** | (2006.01) |
| ***B65C 9/42*** | (2006.01) |
| ***B65C 9/00*** | (2006.01) |

(52) U.S. Cl.

CPC ..... *B65C 9/1807* (2013.01); *B65C 9/0062* (2013.01); *B65C 9/188* (2013.01); *B65C 9/1819* (2013.01); *B65C 9/40* (2013.01); *B65C 9/42* (2013.01); *B65C 2009/0081* (2013.01); *B65C 2009/1838* (2013.01); *Y10T 156/1326* (2015.01)

(58) Field of Classification Search

CPC ..... B65C 9/1807; B65C 9/40; B65C 9/42; B65C 9/0062; Y10T 156/1326

See application file for complete search history.

(56) References Cited

U.S. PATENT DOCUMENTS

| | | | | |
|---|---|---|---|---|
| 5,413,651 | A * | 5/1995 | Otruba | B26D 5/20 156/351 |
| 6,450,230 | B1 * | 9/2002 | Otruba | B65C 9/1807 156/542 |
| 6,471,802 | B1 * | 10/2002 | Williamson | B65C 9/1819 156/250 |
| 2011/0240229 | A1 * | 10/2011 | Schinelli | B65C 9/00 156/494 |
| 2012/0234495 | A1 * | 9/2012 | Ballarotti | B65C 9/1819 156/517 |
| 2013/0192766 | A1 * | 8/2013 | Erhart | B65C 3/14 156/556 |

FOREIGN PATENT DOCUMENTS

WO WO 2011/027372 A1 3/2011

OTHER PUBLICATIONS

Italian Search Report for corresponding Italian Patent Application No. MI2013A001161 dated Mar. 12, 2014.

* cited by examiner

*Primary Examiner* — Mark A Osele
*Assistant Examiner* — Christopher C Caillouet
(74) *Attorney, Agent, or Firm* — Merchant & Gould P.C.

(57) ABSTRACT

A labelling machine (1) for labelling containers moving on a transport system (2), includes a labelling unit (8) having a supplying roll (19) of a pre-printed label web and a cutting drum (20) providing for both cutting a label from the label web and applying it onto a container. The cutting drum (20) is located at the release point of a label to the container to be labeled.

16 Claims, 11 Drawing Sheets

LABELLING UNIT OF CONTAINERS

This application claims benefit of Serial No. MI2013A001161, filed 10 Jul. 2013 in Italy and which application is incorporated herein by reference. To the extent appropriate, a claim of priority is made to the above disclosed application.

BACKGROUND OF THE INVENTION

The present invention relates to a labelling unit of containers, particularly bottles.

The labelling of containers and, in particular, bottles is an operation that may be carried out in different stages of the process of preparing bottled beverages, although it is most commonly performed immediately after filling the bottle.

There are several types of labelling.

A first type uses self-adhesive labels, which are released from a base web on which the labels are adhered at even intervals, usually almost in contact one to another. The release of the single label is performed immediately before applying it onto the container to be labeled.

A second type of labelling machine uses a continuous web on which the single labels are directly printed. In this case, the label cutting operation is performed at a remote position with respect to the point where the label is applied on the container. The label, cut and by now singularized, is hold on a drum in vacuum or provided with mechanical gripping members, which provides to send it, after a passage in a glue coating unit, to the next labelling unit.

Although the latter type of label is less expensive compared to the self-adhesive labels, the handling of the singularized labels involves a complication both at the structural level (higher complexity and dimension of the labelling machine) and in managing the labelling process.

SUMMARY OF INVENTION

The object of the present invention is to provide a labelling machine that is versatile, that simplifies the handling process of the labels, and that is adaptable to several types of bottling plants or handling and processing plants of containers in general.

BRIEF DESCRIPTION OF THE DRAWINGS

Further characteristics and advantages of the present invention will be more apparent from the description of some embodiment examples, given herein below by way of illustrative, non-limiting example, with reference to the following figures.

DETAILED DESCRIPTION OF THE PREFERRED EMBODIMENTS

Figure 1:
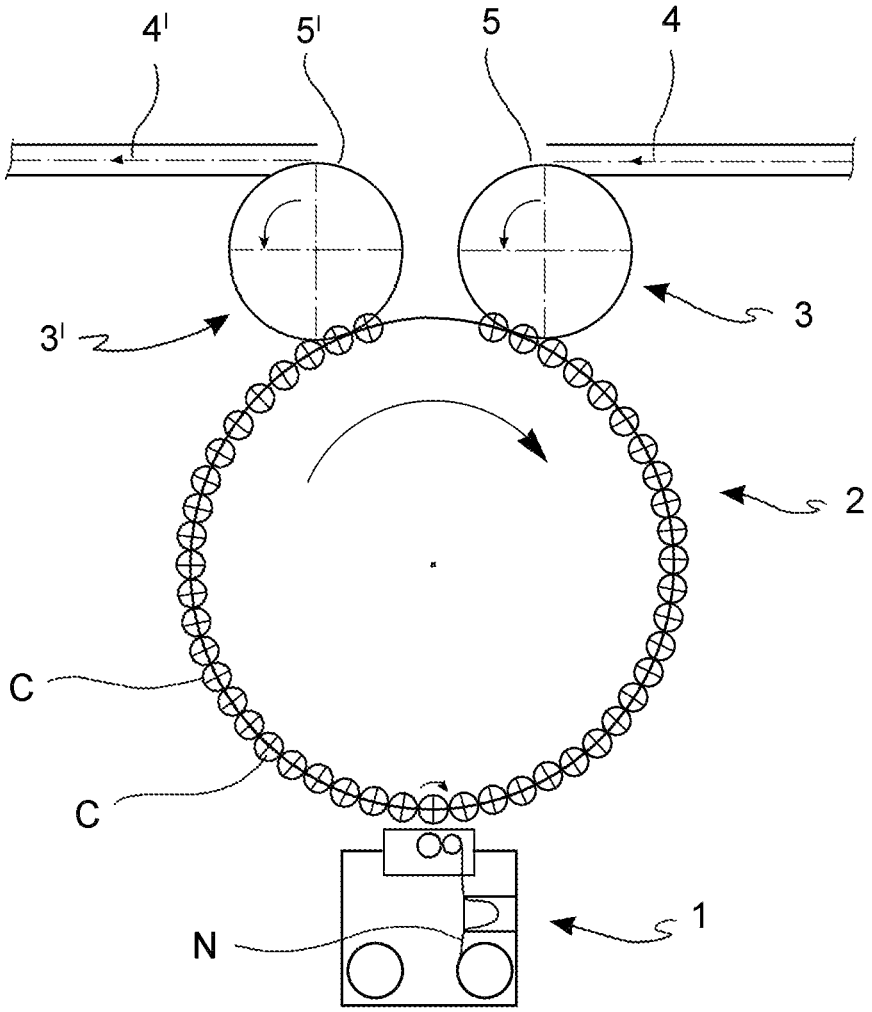
FIG. 1 represents a plan schematic view of a detail of a container handling plant to which the labelling machine of the invention is applied.

With reference to FIG. 1, the labelling machine according to the invention, generally indicated with the number 1, is applicable to a conventional plant 2 for handling containers C. The plant 2 schematized in FIG. 1 is a carousel, to which the containers C coming from a previous processing operation, for example, a filling step, are released from a transport system 3 that typically may comprise a conveyor 4, for example, a screw, and a distribution star 5.

The containers, after passing in the proximity, of the labelling machine 1 and having been thus labelled, are withdrawn by a second transport system 3' that, similarly to the previous one, may comprise a distribution star 5' and a conveyor 4'.

The labelling machine 1 comprises a frame 6 supporting a platform 7 on which a labelling unit 8, unwrapping means 9 of a label web N, and a buffer chamber 16 are mounted. A series of return rolls 17, mounted idle on the platform 7, defines the path of the label web N between the unwrapping means 9 and the labelling unit 8.

The frame 6 comprises a base 10 provided with feet 11 for the support on a support surface. A pantograph system 12 supporting the platform 7 is mounted on the base 10.

The pantograph system 12 comprises at least one articulated parallelogram comprising a lower bar 13*a* and an upper bar 13*b*, between which two articulated arms 14*a*, 14*b* are arranged. In the embodiment shown in the figures, two articulated parallelograms, one at each side, are arranged.

The articulated arms 14*a*, 14*b* are mutually hinged at about the middle of the length thereof, so as to create an X-shaped configuration. A first articulated arm 14*a* is further hinged at an end on the upper bar 13*b*, while the opposite end is slidably constrained at the lower bar 13*a*.

Figure 3:
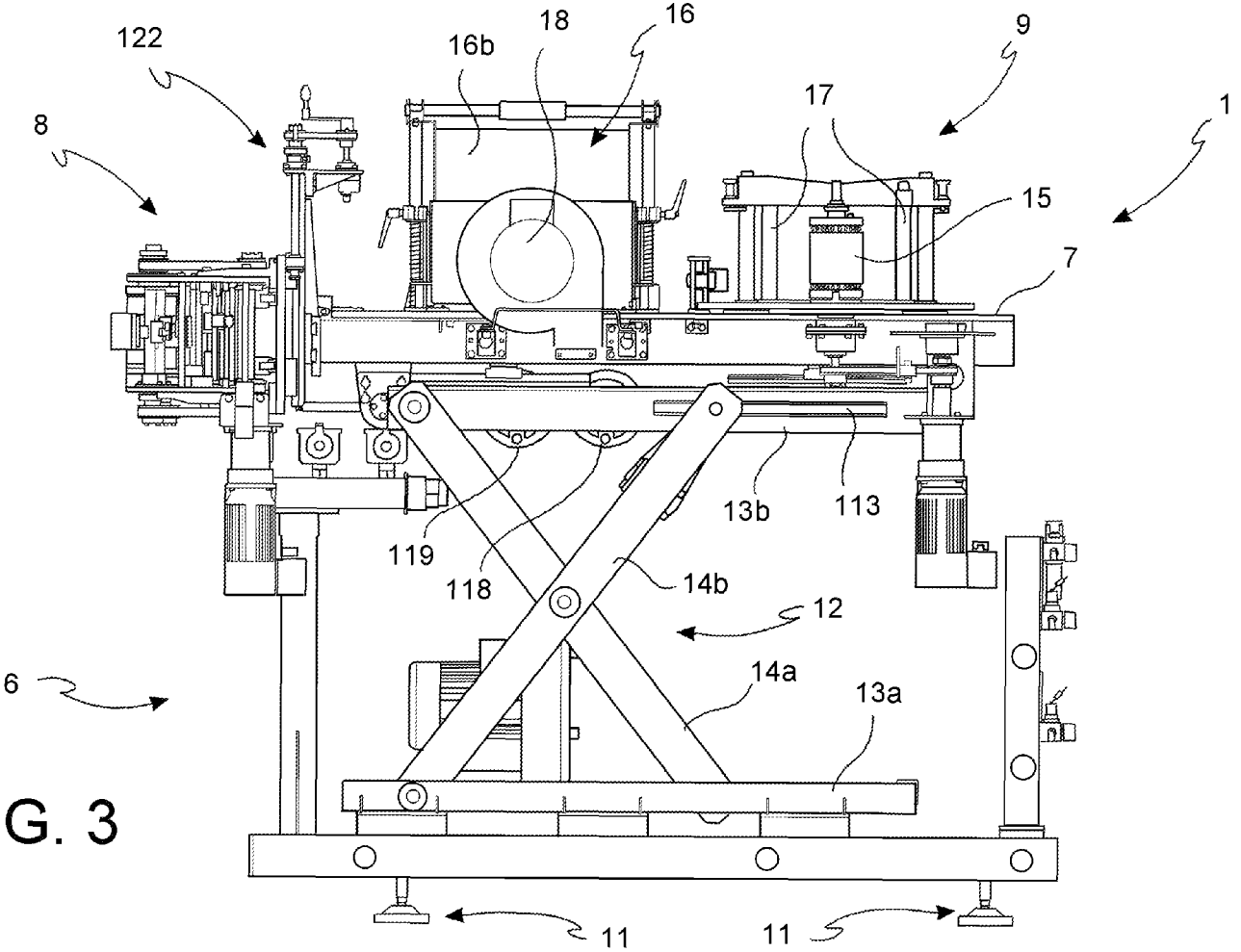
FIG. 3 represents a side view of the labelling machine of the invention.

Vice versa, an end of the second arm 14*b* is hinged to the lower bar 13*a*, while the opposite end is slidably constrained on the upper bar 13*b*. In this manner, making the lower and upper ends of the first and the second arms 14*a*, 14*b*, respectively, to slide along the lower 13*a* or the upper 13*b* bars, the lowering or lifting of the pantograph system 12 can be obtained, as shown in the FIGS. 3 (lifted position) and 4 (lowered position). This movement can be obtained by a suitable motorization, or manually.

Figure 6:
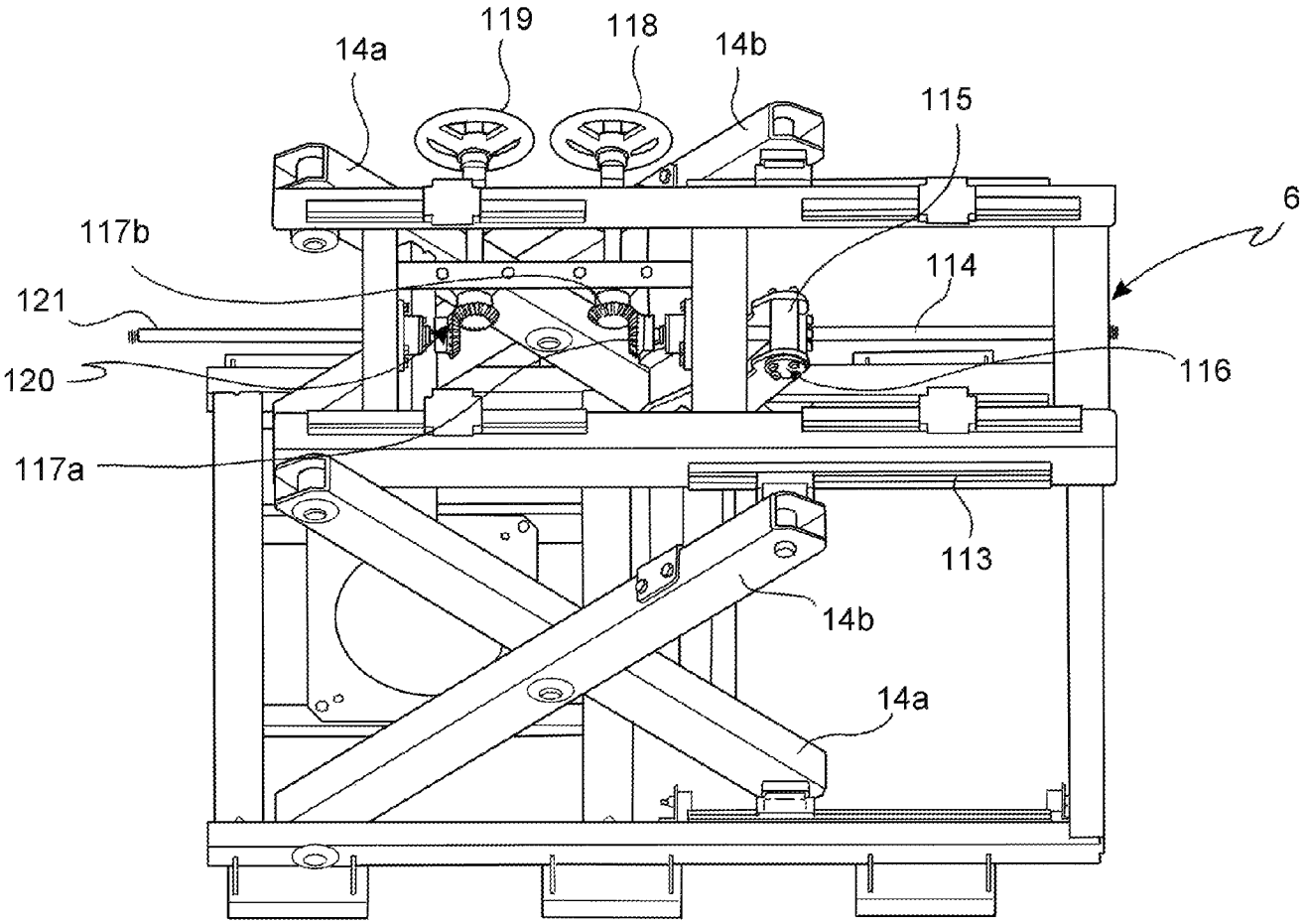
FIG. 6 represents a partial top view of the frame of the labelling machine of the invention.

For example, as shown in FIG. 6, the sliding of the upper end of the second arm 14*b* in a guide 113 arranged on the upper bar 13*b* occurs by acting by rotation on a shaft 114 having a threaded section operatively associated to a lead nut 115 secured to a connection member 116 integral to the second arm 14*b*. The shaft 114 is rotatably supported on the frame 6 and ends at an end with a conical gear 117*a* coupled with a second conical gear 117*b* driven by a steering wheel 118. The driven sliding of the upper end of the second arm 14*b* in the guide 113 makes it to move away from the upper end of the first arm 14*a* and consequently also the mutual moving away of the corresponding lower ends.

Figure 4:
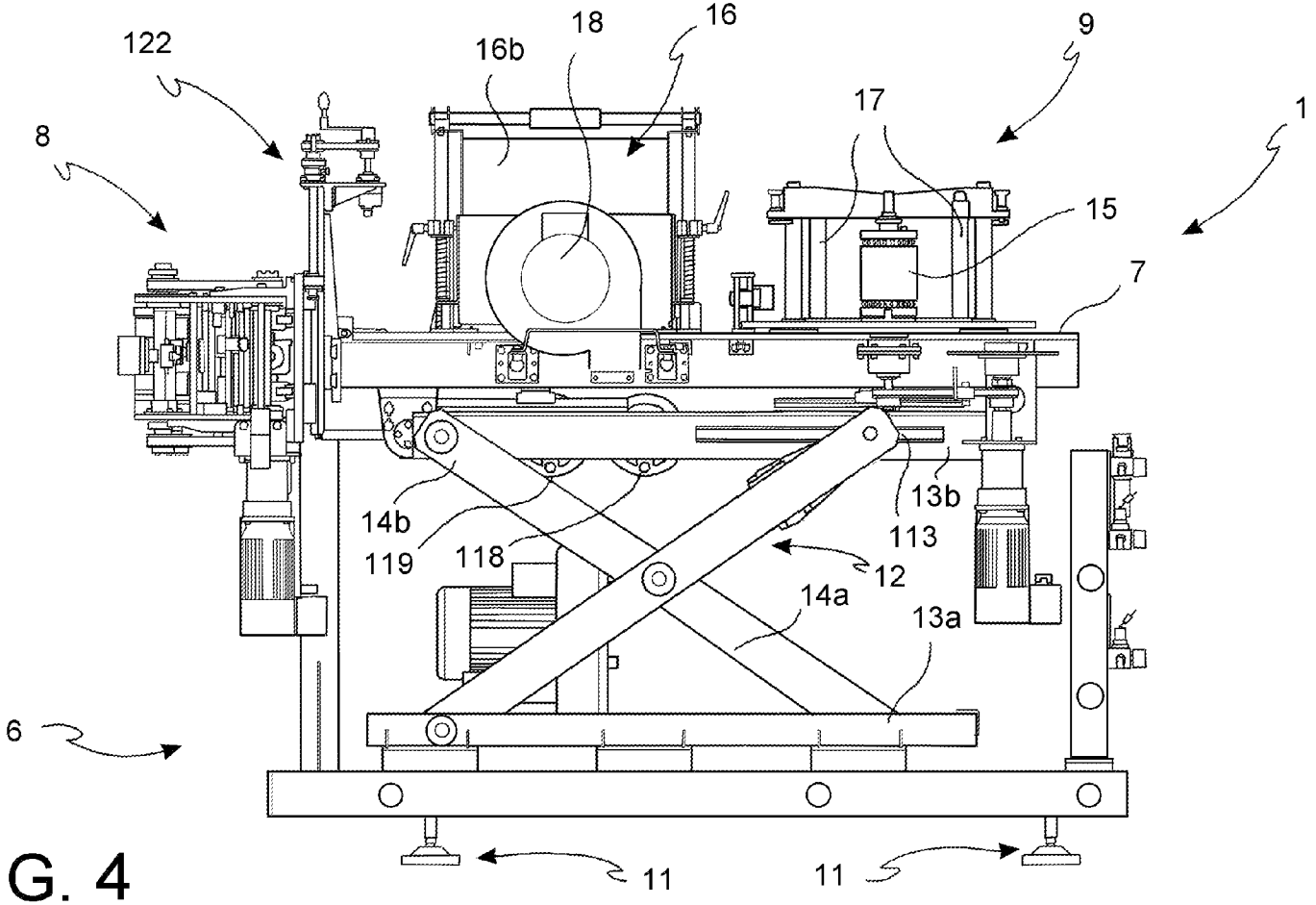
FIGS. 4 and 5 represent the view of FIG. 3 in different operative positions.
Figure 5:
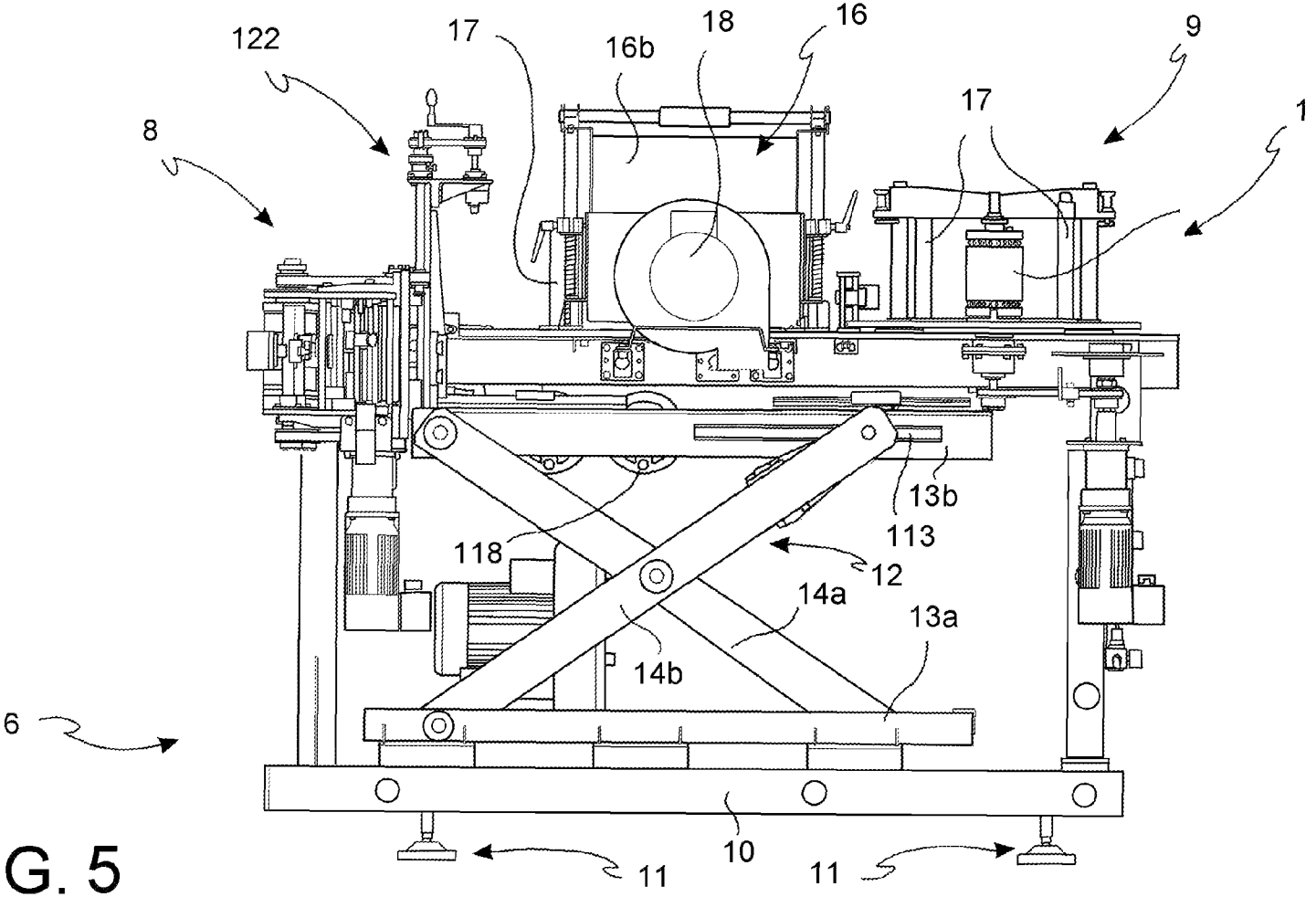

As shown in the FIGS. 4 and 5, the platform 7 is slidably mounted on the pantograph system 12.

The horizontal handling of the platform 7 with respect to the frame 6 may occur with a mechanism completely similar to that described above for the pantograph system 12 and only partially shown in FIG. 6. Such mechanism comprises a steering wheel 119 actuating, through a conical coupling 120, a shaft 121 having a threaded section operatively connected to a lead nut (not shown) integral to the platform 7. In this manner, the sliding of the lead nut on the shaft 121 can be obtained, and thus also the movement of the platform 7, in a direction rather than in the opposite one, according to the fact that the steering wheel 119 is rotated clockwise or counter-clockwise.

The labelling unit 8 is adjustable both in height and laterally.

Figure 7A:
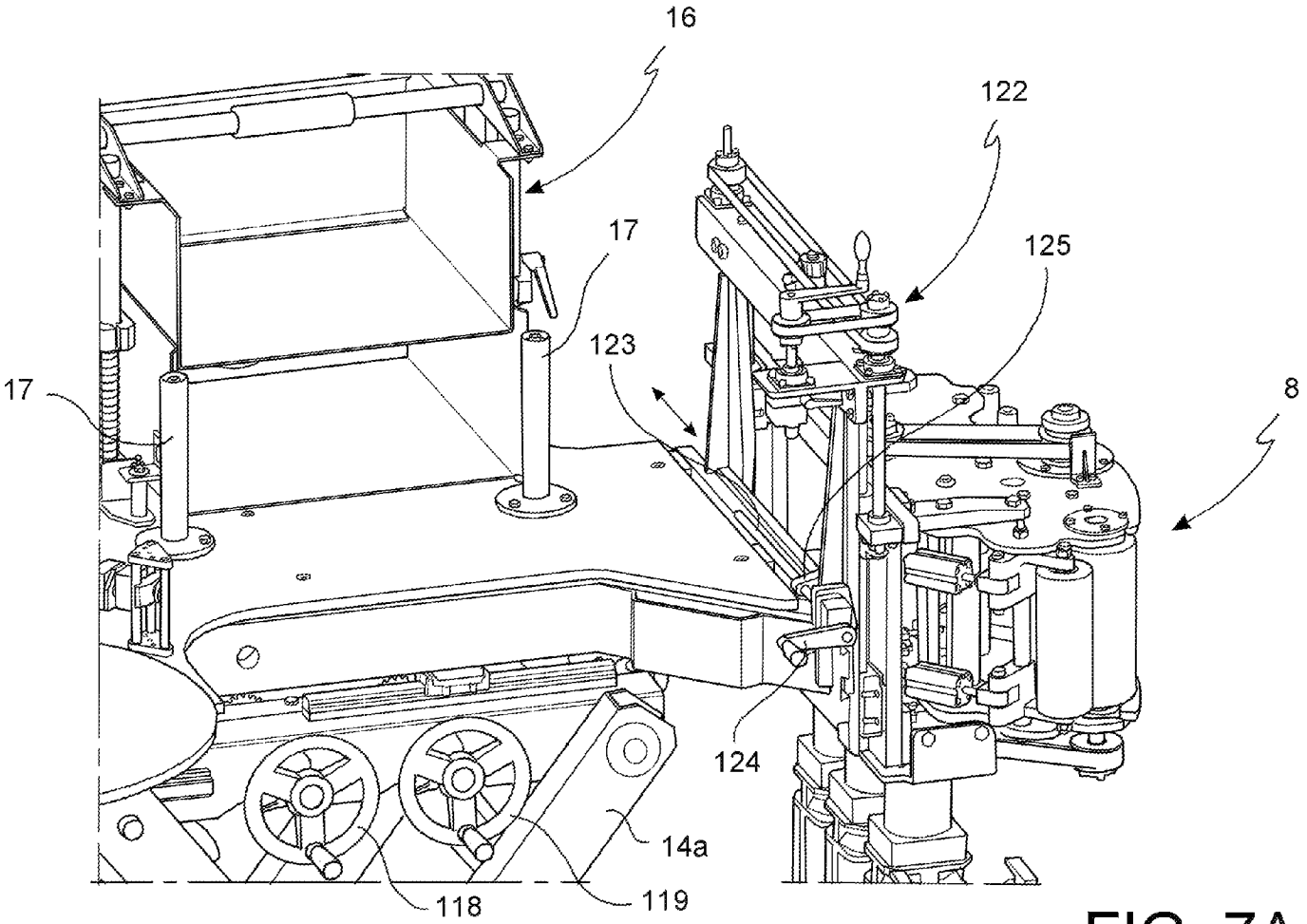
FIG. 7A represents a partial perspective view of the labelling machine 1 according to the invention, showing the height and lateral adjusting system of the labelling unit.

As shown in FIG. 7A, the labelling unit 8 is secured to an adjustable structure 122, that provides to move the labelling unit 8 both vertically and laterally with respect to the platform 7.

An endless screw 123 driven by a crank handle 124 cooperates with a lead nut 125 secured to the adjustable structure 122, allowing the sliding thereof in a special guide (not shown) according to the directions of the arrow.

Figure 7B:
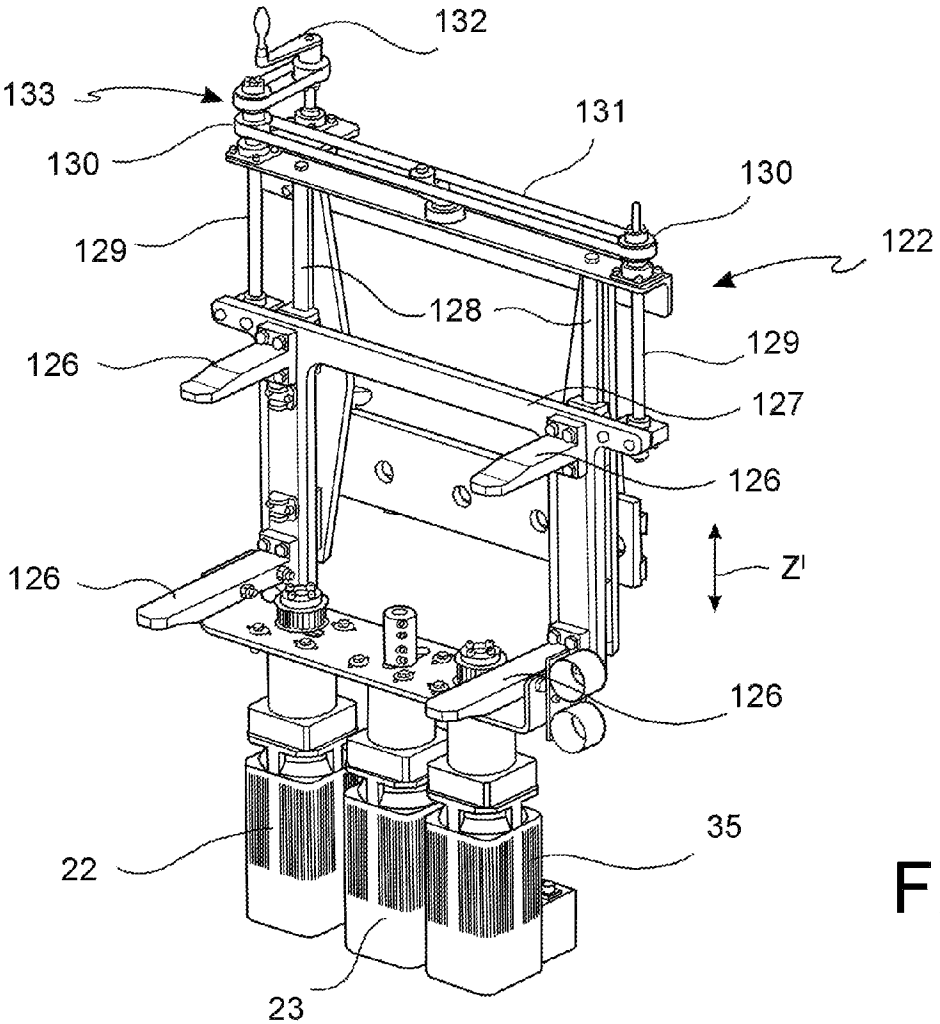
FIG. 7B represents a perspective view of a detail of FIG. 7A.

The adjustable structure 122, shown in FIG. 7B, comprises a plurality of brackets 126, particularly four brackets, to which the labelling unit 8 is secured. The brackets 126 are in turn secured to a movable frame 127, vertically slidable on a track 128. The movable frame 127 is operatively connected, by a lead nut coupling, to a pair of threaded bars 129, rotatably supported on the adjustable structure 122. The upper ends of the threaded bars 129 end with corresponding pinions 130 connected by a belt 131. One of the two pinions 130 is actuated by a crank handle 132, for example, as shown in FIG. 7B, my means of a return mechanism 133.

The unwrapping means 9 of the label web N comprise at least one reel-holding roll 15. In the machine shown in the figures, two rolls 15 are present, so as to minimize the interruptions for replacing the reel.

Each of the reel-holding rolls 15 is motorized, preferably by a stepper or brushless motor.

The buffer chamber 16 comprises side walls 16*a* and a bottom wall 16*b*. Suction means 18 are arranged on the bottom wall 16*b*. The function of the buffer chamber 16 is to absorb the web N excesses that occur when the label web N is unwrapped at a higher speed than the gripping speed by the labelling unit 8.

Figure 8:
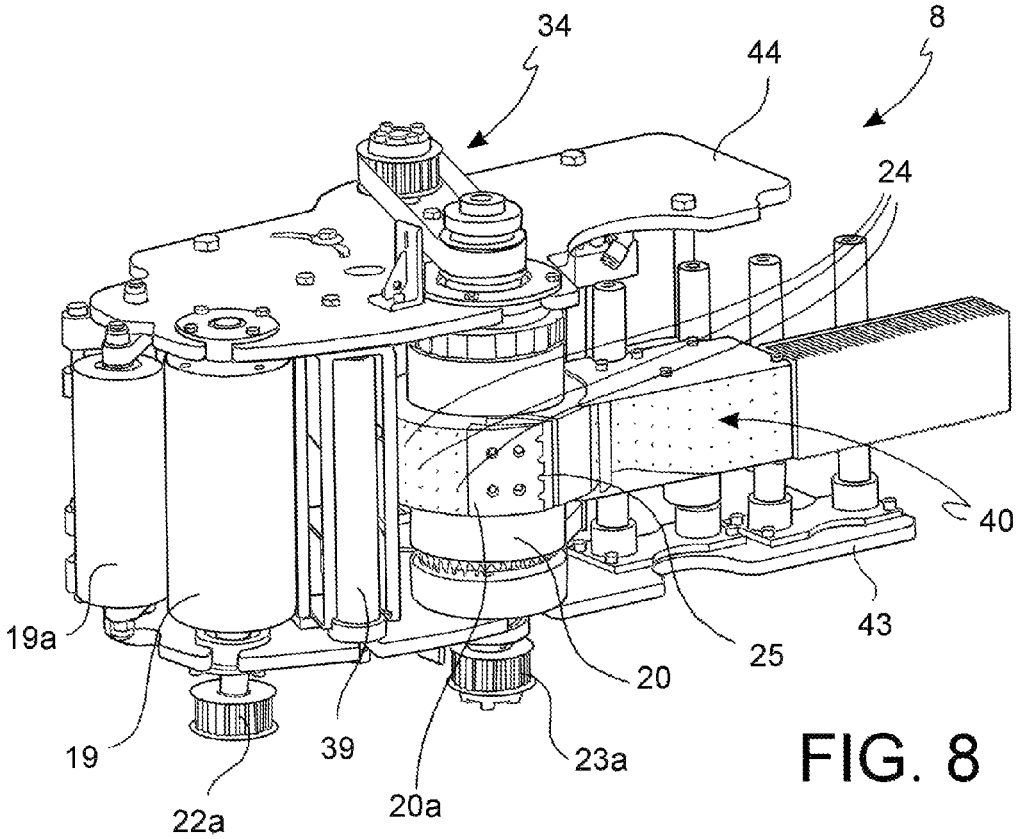
FIG. 8 represents a perspective view of the labelling unit of the labelling machine of the invention.
Figure 9:
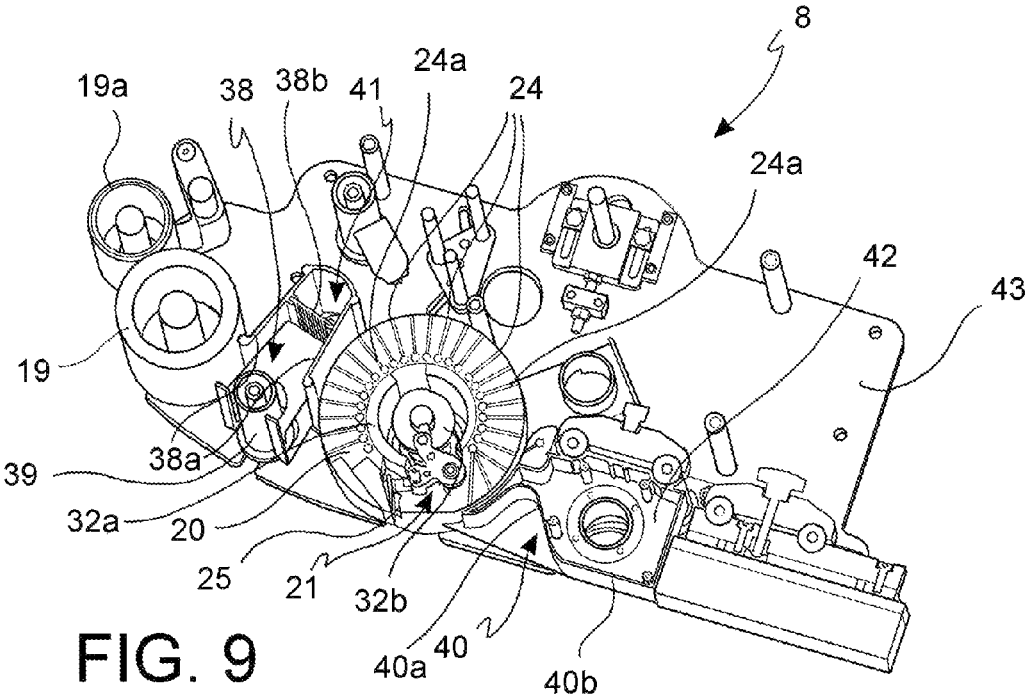
FIG. 9 represents a top perspective view according to a horizontal section of the labelling unit of FIG. 8.

As shown in the FIGS. 8 and 9, the labelling unit 8 comprises a supplying roll 19 of the label web N, and a cutting drum 20 providing for both cutting a label E from the label web N and applying it onto the container C.

The supplying roll 19 is motorized by a motor 22, to which it is connected by a suitable transmission mechanism 22*a* (FIGS. 7B and 8). The motor 22 is preferably a stepper or brushless motor.

The supplying roll 19 also comprises an idle-mounted counter-roll 19*a*, which promotes the grip of the supplying roll 19 on the label web N. The counter-roll 19*a* is opposite the supplying roll 19, so that the label web N, passing between the counter-roll 19*a* and the roll 19, is compressed against the latter.

In certain embodiments, the surface of the supplying roll 19 or that of the counter-roll 19*a* or both are made of an elastic material, such as rubber or a synthetic elastomer.

In certain embodiments, the outer surface of the supplying roll 19 is texturized so as to have a high grip, for example by a knurling or a honeycomb texture.

The cutting drum 20 is also motorized by a motor 23, to which it is connected by suitable transmission mechanism 23*a* (FIGS. 7B and 8). The motor 23 is preferably a stepper or brushless motor.

The cutting drum 20 is hollow, and it has externally a suctioned surface 20*a* for the label web N.

The suctioned surface 20*a* has a plurality of holes 24 that put it in communication, through ducts 24*a* obtained in the body of the cutting drum 20, with suction means (not shown). In this manner the suctioned surface 20*a* is put under vacuum in order to keep the web N in constant contact thereon.

The cutting drum 20 contains therein cutting means 21 mobile between a retracted position within the cutting drum 20 and an extended position, in which the cutting means project from the suctioned surface 20*a* through a vertical slit 25 that is present thereon.

Figure 10:
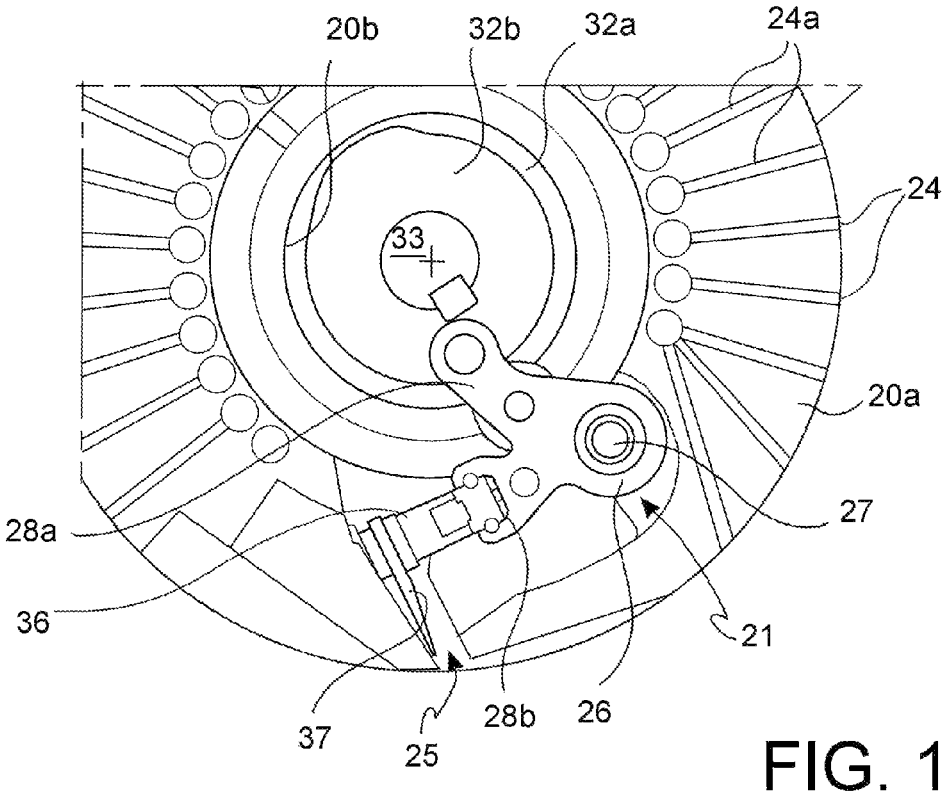
FIG. 10 represents a top sectional view of a detail of the cutting drum.
Figure 11:
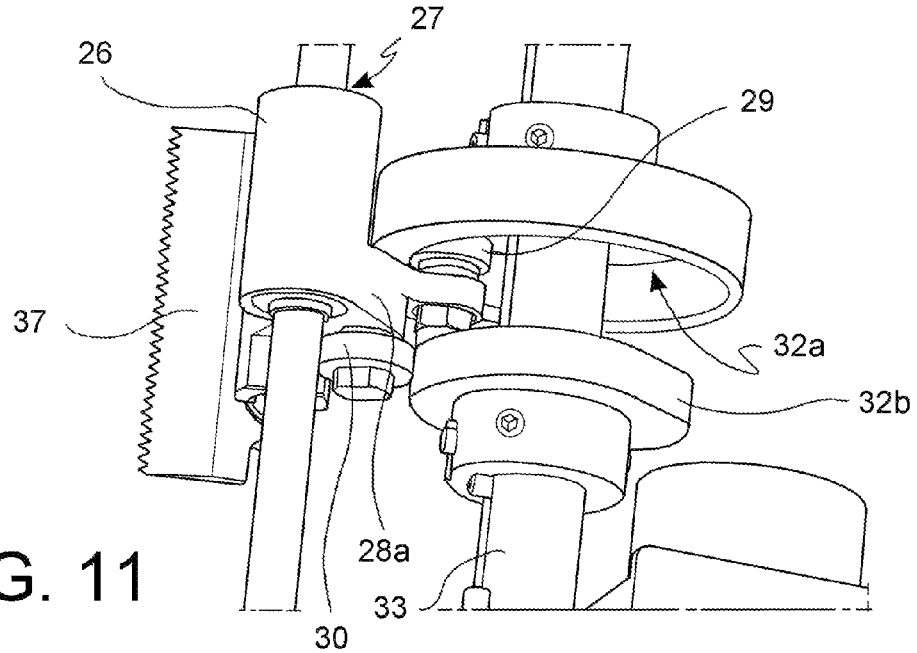
FIG. 11 represents a perspective view of a detail of the cutting blade moving mechanism.
Figure 12:
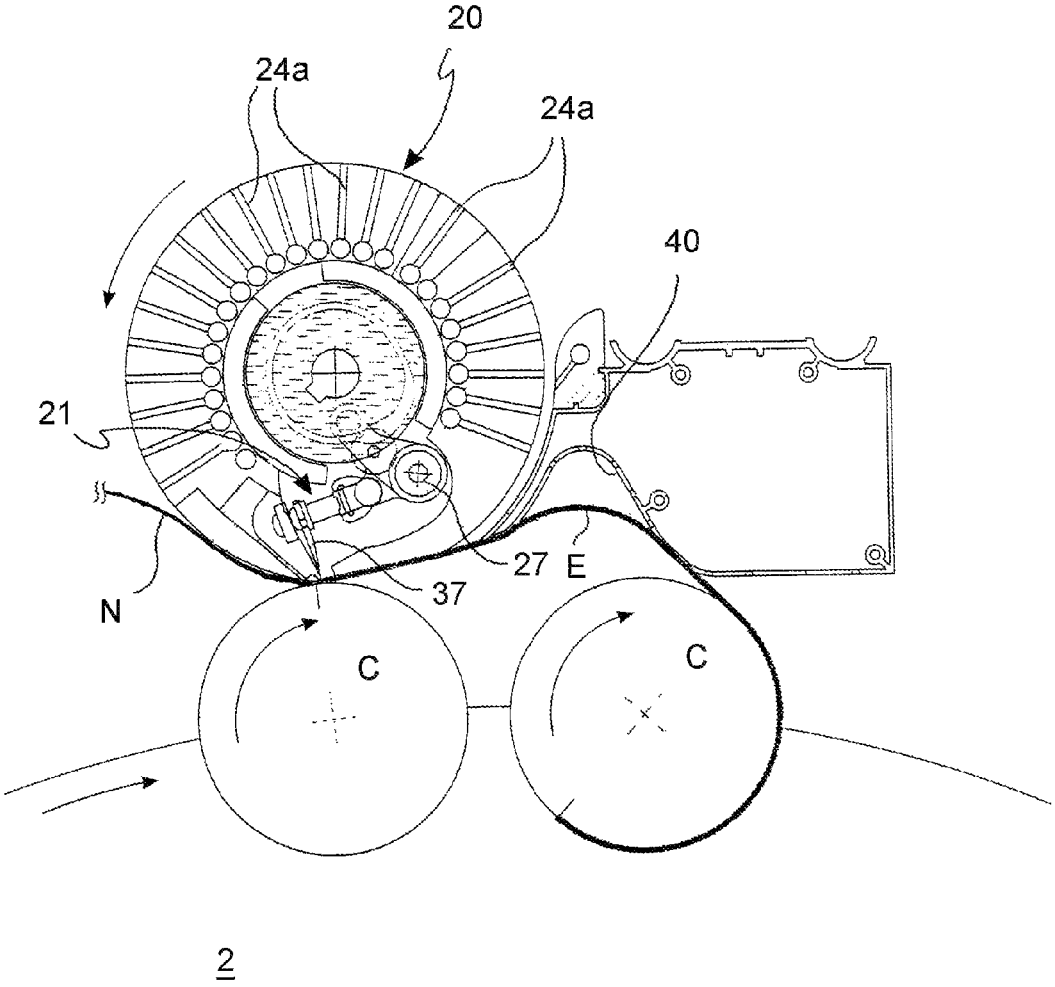
FIG. 12 represents a simplified plan and sectional view of a cutting step of a label with the labelling machine of the invention.

As shown in the FIGS. 10 and 11, the cutting means 21 comprise a mobile member 26 hinged on a hinge 27 arranged within the cutting drum 20 and having a first arm 28*a*, extending towards the central cavity 31 of the cutting drum 20, and a second arm 28*b*, extending in a direction substantially parallel to a tangent to the suctioned surface 20*a*.

The second arm 28*b* comprises a blade support 36 projecting up to the proximity of the vertical slit 25 of the cutting drum 20, on which blade support 36 a blade 37 is perpendicularly mounted, so as to create an L-shaped configuration. Therefore, the blade 37 is inserted in the vertical slit 25, without surfacing from the suctioned surface 20*a*.

The blade 37 preferably has a toothed profile, to promote the cutting operation.

A first drive roller 29, suitable to interact with the profile 20*b* of a first cam 32*a*, and a second drive roller 30, suitable to interact with the profile of a second cam 32*b* are rotatably mounted on the first arm 28*a*.

The cams 32*a* and 32*b* are integral to a shaft 33, connected to a motor 35 by a suitable transmission mechanism 34 (see FIGS. 8 and 7B).

In the embodiment shown in the figures, the first cam 32*a* is in the shape of an overturn cup, so as to expose internally the reactive profile for the first drive roller 29.

The cams 32*a*, 32*b* have conjugated profiles so as to produce a swiveling movement of the mobile member 26 about the hinge 27 between said retracted position and said extended position of the cutting means 21, in which the cutting operation of the label occurs.

A buffer chamber 38 is arranged between the supplying roll 19 and the cutting drum 20.

The buffer chamber 38 has side walls 38*a* and a perforated bottom wall 38*b*, so as to be in flow communication with a suction chamber 41, in turn connected to suction means (not visible). A return roll 39 for the label web N is mounted idle in front of the buffer chamber 38.

The buffer chamber 38 has the following function: when a labelling gap occurs, for example, if the container is not present on a plate of the carousel, or in the case of a displacement, the cutting drum 20 stops or slows down. Vice versa, the supplying roll 19 continues to dispense the label web N, which then builds up in the buffer chamber 38. In this manner, it is possible to start again at the maximum speed with the labelling of the next container.

A suctioning loop 40 is arranged downstream of the cutting drum 20 with respect to the forward direction of the container to be labeled. The suctioning loop 40 has a first portion 40*a*, in the proximity of the cutting drum 20, having a concave profile; and a second portion 40*b* with a profile conjugated to the trajectory of the generatrix of the container to be labeled during transit. For example, in the case of a coupling of the labelling machine to a rotating carousel, the portion 40*b* will have a curvilinear profile conjugated to the arc of a circle of the carousel subjected to the label transferring operation. Vice versa, in the case of a coupling of the labelling machine with a linear transport system, the portion 40*b* will have a rectilinear profile.

The suctioning loop 40 surface is perforated, thus it is in flow communication with a suction chamber 42, in turn connected to suction means (not visible).

The labelling unit 8 is contained between a base plate 43 and a cover plate 44, which promotes the assembling thereof on or the disassembling thereof from the adjustable structure 122.

The operation of the labelling machine 1 is as follows.

The label web N, on which the single labels are printed at even intervals, is unwrapped from the reel mounted on one of the reel-holding rolls 15, passes on return rolls 17 through the buffer chamber 16, then through the supplying roll 19 and the counter-roll 19*a*. As it has been stated, both the reel-holding roll 15 and the supplying roll 19 are motorized, and the buffer chamber 16 helps to temporarily house the web N stockpiles that may occur when the unwrapping speed of the web N is higher than the gripping speed by the supplying roll 19.

The label web N can be made adhesive in advance at predetermined intervals corresponding to the head and tail portions of the labels to be cut. In other embodiments, a web without an adhesive will be used, but in this case, means to deposit the glue at predetermined positions will have to be provided along the web path.

After the supplying roll 19, the label web passes on the return roll 39, and it is then suctioned on the suctioned surface 20*a* of the cutting drum 20.

The cutting drum 20 is tangent to a container C coming onto the carousel 2. The container C is supported on a small plate that rotates it, whereby the head of the label web N adheres to the surface of the container C and starts to wrap thereon. At the same time, the container C continues its stroke on the carousel 2. At this point, when a predetermined label length has been wrapped on the container C, the blade 37 exits the vertical slit 25 of the cutting drum 20 and cuts the label E, thus singularizing it.

The label E tail is kept tensioned and controlled by suctioning of the suctioning loop 40.

The cutting drum 20, put in rotation by the motor 23, has a variable motion profile: in fact, it will have a homokynetic rotation with the rotation of the container to be labeled for an angle of rotation corresponding to the transfer step of the label from the cutting drum 20 to the container until cutting the label E, while it will rotate at a higher peripheral speed along the remaining explementary angle, so as to bring the vertical slit 25 from which the blade 37 exits to the right position for the next cut of a label in the time necessary for the next container arrives to the tangent position. During the rotation at a higher speed, therefore, the suctioned surface 20*a* will slide against the label web N, keeping it adhered by virtue of the suctioning force.

The movement of the cutting means 21 from the retracted position to the extended cutting position is obtained by the interaction of the second drive roller 30 with the corresponding cam 32*b*, while the opposite movement is caused by the interaction of the first drive roller 29 with the first cam 32*a*. Under the standard operative conditions, the cams 32*a*, 32*b* are stationary, while the cutting means 21 rotate integrally with the cutting drum 20. The drive rollers 29, 30 do intercept the reactive profiles of the cams 32*a*, 32*b*, rather than vice versa.

However, in order to obtain a neat and efficient cut, it is necessary that the blade 37 is snap-extracted from its seat in the vertical slit 25, which may occur only if the speed at which the drive rollers 29, 30 intercept the reactive profiles of the cams, thus the rotational speed of the cutting drum 20 is sufficiently high.

In those applications in which the rotational speed of the cutting drum 20 is low, a sufficiently high impact speed between drive rollers 29, 30 and cams 32*a*, 32*b* will be obtained, moving the cams to the opposite direction. For example, if the cutting drum 20 rotates in the counter-clockwise direction as in the figures, the shaft 33 on which the two cams 32*a*, 32*b* are mounted will rotate in the clockwise direction, so as to sum the two opposite speeds.

Then, in this case it will be necessary to load the cams 32*a*, 32*b* again, i.e., to bring them back to the start position, so as to repeat the same operation upon the next rotation of the cutting drum 20. Thus the shaft 33 will rotate in the opposite direction, i.e., counter-clockwise in the above example, by an angle corresponding to the hourly rotation angle traveled before, so as to bring the cams 32*a*, 32*b* back to the start position.

Therefore, the cams 32*a*, 32*b* are static if the rotational speed of the cutting drum 20 exceeds a preset value, while they are subjected to a swiveling movement when the rotational speed of the cutting drum 20 is lower than said preset value, as it can be determined empirically by means of operation tests, as a function of the thickness and the type of label to be cut.

In certain embodiments, in order to control the complex motion profiles of the machine, particularly of the cutting drum 20 and the cams 32*a*, 32*b*, according to the various needs required by the different applications, the labelling machine 1 will comprise a drive and control unit. The drive and control unit receives signals about the position, the rotational speed, and the acceleration of the motors connected to the reel-holding rolls 15, the supplying roll 19, the cutting drum 20, the shaft 33 of the cams 32*a*, 32*b*, the carousel 2, and the motorized plates supporting the containers C, and it transmits control commands to them according to a preset motion law. To this aim, all the motorizations will be provided with an encoder. If the motors 22, 23, 35 are brushless motors, they will have an encoder and a programmable controller integrated therein.

The labelling machine 1 of the invention may also comprise an optical control system of the position of the containers C, the label web N, and the printed portions of the labels E. Such an optical control system may comprise photocells and/or video cameras arranged in suitable positions along the path of the containers C and the label web N or in the handling mechanisms. The optical control system provides control signals or images to the drive and control unit, which provides to accordingly change the preset motion law in the case of deviations from a reference standard.

The advantages of the labelling machine according to the invention are many.

First of all, the fact that the cutting drum 20 is arranged at the release point of the label to the container avoids the management of the singularized label E in a path upstream of the labeling, which instead typically occurs in the prior art labelling machines. This involves a greater compactness of the machine and a greater adaptability thereof to various operative needs.

The labelling machine according to the invention further has the possibility to adapt to various types and dimensions of container handling plants. In fact, the pantograph system 12 of the frame 6 and the adjustable structure 122 supporting the labelling unit 8 allow a precise positioning of the labelling unit 8 depending on precise dimensional and type needs both of the transport system from which the containers are brought to the proximity of the cutting drum 20, and of the same container C and the dimension of the label E to be positioned.

For example, the container may have various heights and diameters, or the positioning of the label E on the container C can be provided for in different positions. Furthermore, the transport system, which in the example described above is of the rotating type, consisting in a typical carousel, may have various diameters, or it may also be of the linear type.

Figure 2:
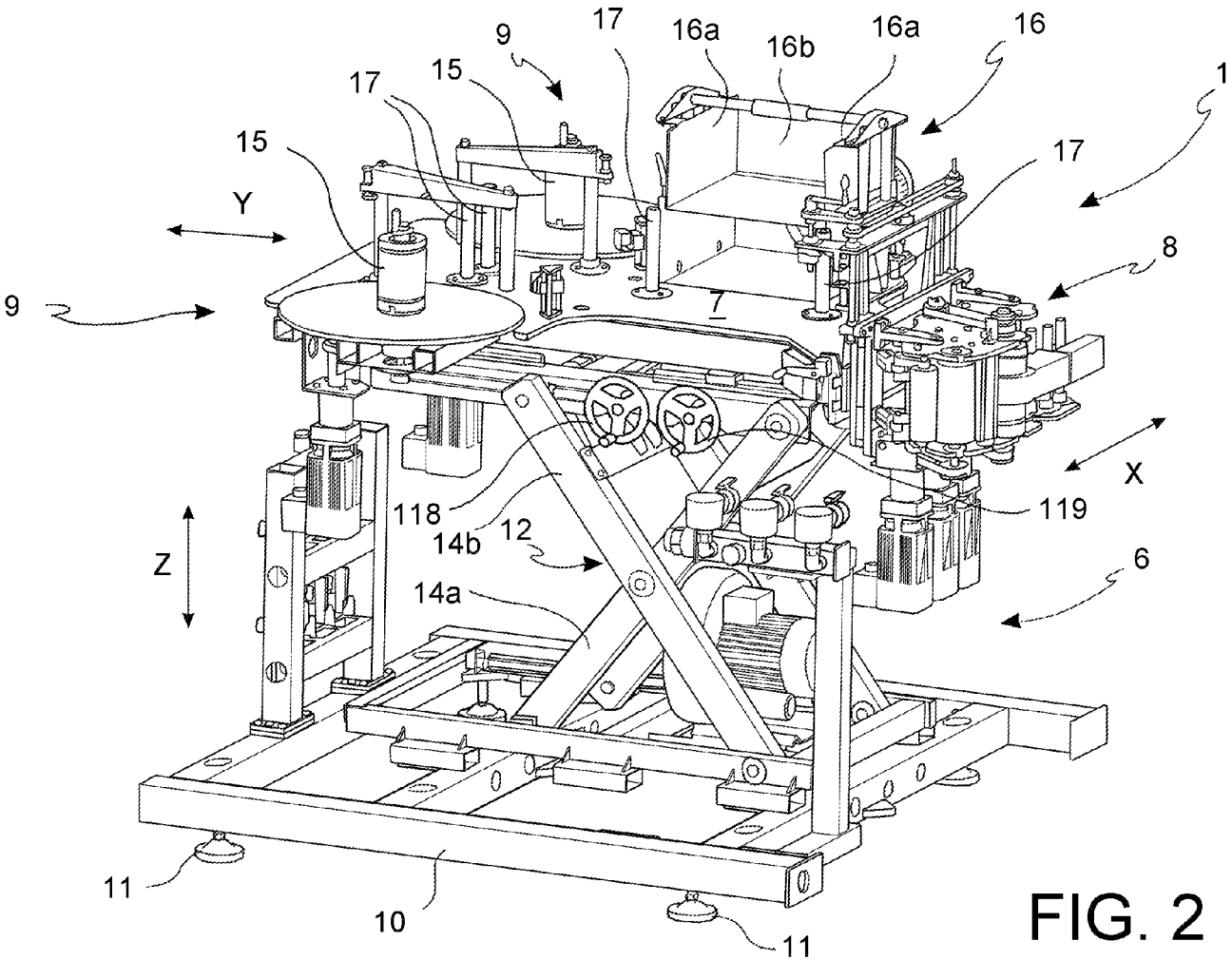
FIG. 2 represents a schematic perspective view of the labelling machine of the invention.

The labelling machine 1 of the invention allows adjusting the labelling unit 8 along all the three axes x, y, and z (as shown in FIG. 2). For an adjustment along the axis z, it is further possible a first adjusting level, which can be obtained by acting on the pantograph system 12 that adjusts in height the platform 7 on which all the operative members of the machine are mounted, and a second, finer adjusting level, which can be obtained by acting on the adjustable structure 122 along the direction z' (FIG. 7B), for the labelling unit 8 only.

It shall be apparent that only some particular embodiments of the present invention have been described, to which those skilled in the art will be able to make all the modifications that are necessary for the adaptation thereof to particular applications, without anyhow departing from the protection scope of the present invention.

The invention claimed is:

1. A labelling machine for labelling containers moving on a transport system, comprising a labelling unit, wherein said labelling unit comprises a supplying roll of a pre-printed label web and a cutting drum providing for both cutting a label from the label web and for laying the label on a first container, wherein the cutting drum is located at the release point of the label to containers to be labeled, and comprises a kinematic device that cuts the label at the point of tangency of the cutting drum to a subsequent container when a head portion of said label web is arranged on said first container.

2. The labelling machine according to claim 1, wherein the labelling unit is adjustable in height and laterally.

3. The labelling machine according to claim 2, wherein the labelling unit is secured to an adjustable structure, said adjustable structure being slidable laterally along a guide and comprising a mobile frame vertically slidable on a track.

4. The labelling machine according to claim 3, wherein the labelling unit is contained between a base plate and a cover plate, wherein said base plate and said cover plate are secured to said adjustable structure.

5. The labelling machine according to claim 1, wherein the supplying roll and the cutting drum are independently motorized through corresponding motors, said motors being stepper or brushless motors.

6. The labelling machine according to claim 1, wherein the cutting drum is hollow, and has externally a suctioned surface for the label web, and wherein the cutting drum contains therein cutting means rotating integrally to the cutting drum, the cutting means being mobile between a retracted position within the cutting drum and an extended position wherein the cutting means project from the suctioned surface.

7. The labelling machine according to claim 6, wherein the cutting means comprise a mobile member hinged on a hinge arranged within the cutting drum comprising an arm, extending in a direction substantially parallel to a tangent to the suctioned surface, a blade being perpendicularly arranged on said arm.

8. The labelling machine according to claim 6, wherein the cutting means comprise a mobile member hinged on a hinge arranged within the cutting drum and having a first arm, extending towards the central cavity of the cutting drum, and a second arm, extending in a direction substantially parallel to a tangent to the suctioned surface, a blade being perpendicularly arranged on said second arm, wherein the blade has a toothed profile, and wherein on the first arm are rotatably mounted a first drive roller, suitable to interact with the profile of a first cam, and a second drive roller suitable to interact with the profile of a second cam, wherein the cams have conjugated profiles so as to produce a swiveling movement of the cutting means between said retracted position and said extended position.

9. The labelling machine according to claim 8, wherein the cams are integral to a shaft, connected to a motor and wherein the cams are static if the rotational speed of the cutting drum exceeds a preset value, while the cams are subjected to a swiveling movement when the rotational speed of the cutting drum is lower than said preset value.

10. The labelling machine according to claim 1, wherein a buffer chamber is arranged between the supplying roll and the cutting drum.

11. The labelling machine according to claim 10, wherein the buffer chamber has side walls and a perforated bottom wall, said bottom wall being in flow communication with a suction chamber, a return roll for the label web being mounted idle in front of the buffer chamber.

12. The labelling machine according to claim 1, wherein downstream of the cutting drum, with respect to the forward direction of the containers to be labelled, a suctioning loop is arranged, having a first portion, in the proximity of the cutting drum, having a concave profile; and a second portion with a rectilinear profile; and wherein the surface of the suctioning loop is perforated and in flow communication with a suction chamber.

13. The labelling machine according to claim 1, said labelling machine comprising a frame supporting a platform on which the labelling unit, unwrapping means of the label web, a buffer chamber, and a series of idle-mounted return rolls are mounted, so as to define a path of the label web between the unwrapping means and the labelling unit, wherein the platform is adjustable in height and according to a longitudinal direction.

14. The labelling machine according to claim 13, wherein the frame comprises a pantograph system supporting the platform and on which the platform is slidably mounted.

15. The labelling machine according to claim 1, wherein said labelling machine comprises a drive and control unit receiving signals about position, rotational speed, and/or acceleration of the motors connected with the reel-holding rolls, the supplying roll, the cutting drum, the shaft of the cams, the carousel, and the motorized plates supporting the containers and transmits control commands according to a preset motion law.

16. The labelling machine according to claim 15, wherein said labelling machine comprises an optical control system of position of the containers, the label web, and the printed portion of the labels, wherein said optical control system comprises photocells and/or video cameras or functional equivalents arranged in suitable positions along a path of the containers and the label web or in the handling mechanisms, and wherein the optical control system provides control signals or images to the drive and control unit, which provides to accordingly change preset motion law in case of deviations from a reference standard.

* * * * *